United States Patent [19]

Nagahara

[11] 4,267,663

[45] May 19, 1981

[54] RADIO-CONTROLLED STEERING DEVICE FOR TOY MOTORCYCLES

[76] Inventor: Sin Nagahara, 32-12, Minamicho, Itabashiku, Tokyo, Japan

[21] Appl. No.: 88,311

[22] Filed: Oct. 25, 1979

[51] Int. Cl.[3] ..... A63H 30/04; A63H 17/36; A63H 11/10

[52] U.S. Cl. ..... 46/254; 46/262; 46/106

[58] Field of Search ..... 46/210, 254–255, 46/201, 202, 206

[56] References Cited

U.S. PATENT DOCUMENTS

| | | | |
|---|---|---|---|
| 2,159,974 | 5/1939 | Lohr | 46/210 |
| 2,699,011 | 1/1955 | Sedgwick | 46/210 |
| 2,814,908 | 12/1957 | Ernst | 46/107 |
| 3,546,814 | 12/1970 | Melendez | 46/254 |

*Primary Examiner*—Gene Mancene
*Assistant Examiner*—Michael J. Foycik, Jr.
*Attorney, Agent, or Firm*—Sughrue, Rothwell, Mion, Zinn and Macpeak

[57] ABSTRACT

A frame of the motorcycle rotatably bears at its rear end, the rear wheel and has, at the front end, a pivot shaft extending along the central axis of the frame. Rotatably connected to the pivot shaft is a connecting block that supports a handle shaft axis of the front wheel.

The connecting block is rotated about the pivot shaft by a servomotor which is driven by the signals from the transmitter and whose rotating force is conveyed to the block via the transmission mechanism whereby the frame is forcibly banked to turn the motorcycle.

3 Claims, 8 Drawing Figures

RADIO-CONTROLLED STEERING DEVICE FOR TOY MOTORCYCLES

BACKGROUND OF THE INVENTION

1. Field of the Invention

This invention relates to a radio-controlled steering device for toy motorcycles.

2. Description of the Prior Art

Generally, toy motorcycles are not stable while running because of its structure and the steering is very difficult.

As a means for turning a toy motorcycle, it has been proposed that, to obtain the same effect as in the ordinary motorcycle, the frame of the toy motorcycle be provided with a weight that is moved to shift the center of gravity of the frame. In this construction, however, since the fulcrum of the motorcycle is the contacting portions of the front and rear wheels, with the ground the banking angle acceleratingly increases when the frame is banked by shifting the weight. Thus, it is difficult to maintain a desired banking angle. Furthermore, this type of toy motorcycle has another disadvantage that, because of the inertia of the weight, it cannot be quickly and smoothly returned from the banked position to the upright position or straight running position and the motorcycle rolls sideways.

It has also been proposed that a rotating gyro be built into the front wheel to enable the motorcycle to run smoothly. This is impracticable, however, since the structure and therefore the manufacturing process are complicated and it is difficult to control the rotating speed of the gyro.

SUMMARY OF THE INVENTION

The steering device according to this invention is characterized by the fact that the frame and the fork of the front wheel are connected by a connecting block that can be freely rotated about the pivot axis or the longitudinally extending central axis of the frame whereby the frame is banked relative to the front wheel to turn the motorcycle.

Another feature of this invention is that the connecting block is connected to a servomotor with or without a transmission mechanism therebetween and is rotated in response to the rotation of the servomotor driven by signals from the transmitter.

Therefore, an object of this invention is to provide a toy motorcycle steering device that is very simple in construction and inexpensive.

Another object of this invention is to provide a toy motorcycle steering device that has excellent maneuverability and stability.

Still another object of this invention is to provide a toy motorcycle steering device by which a desired bank angle can be obtained by turning a servomotor a required angle to freely determine the radius of turn.

These and other objects of this invention will become apparent from the following description of preferred embodiments.

DETAILED DESCRIPTION OF THE PREFERRED EMBODIMENTS

Figure 1:
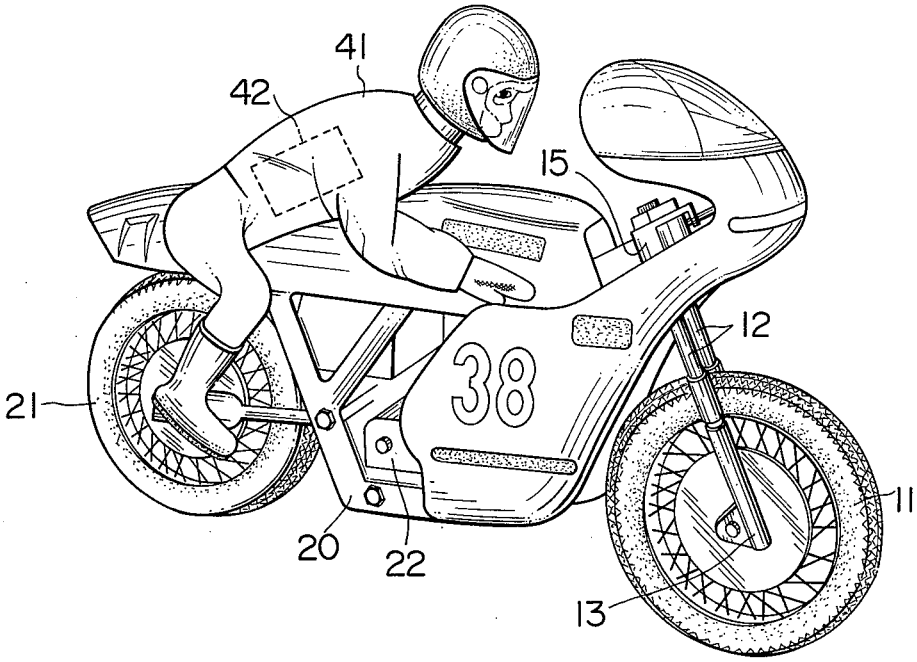
FIG. 1 is a perspective view showing the outline of a toy motorcycle mounting the radio-controlled steering device of this invention.
Figure 2:
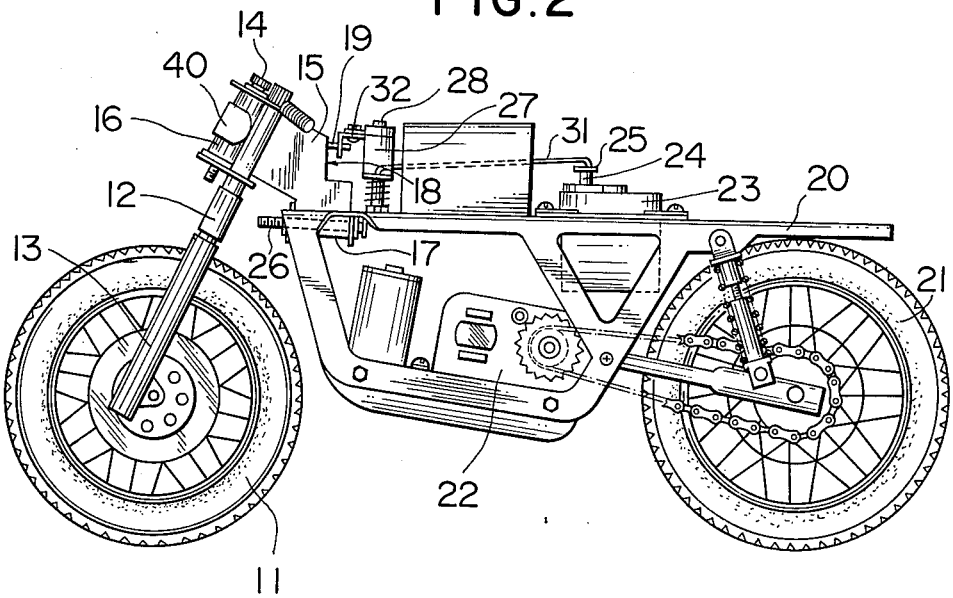
FIG. 2 is a side view of an essential portion of the toy motorcycle incorporating radio-controlled steering device.
Figure 3:
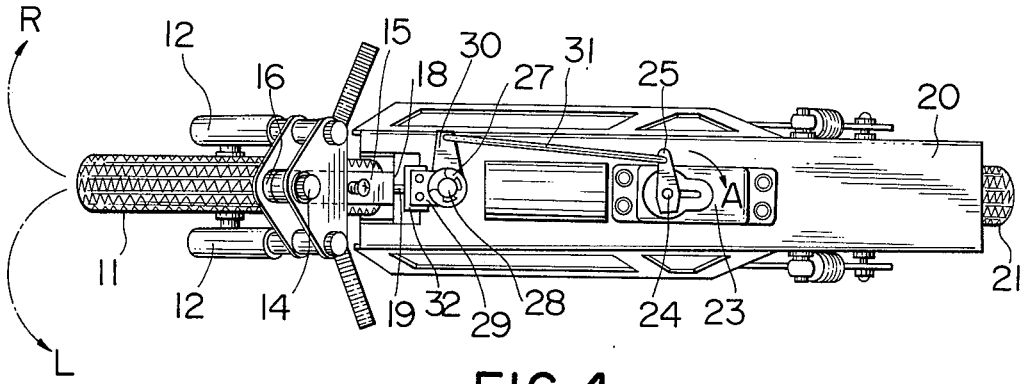
FIG. 3 is a plan view of the toy motorcycle as shown in FIG. 2.
Figure 4:
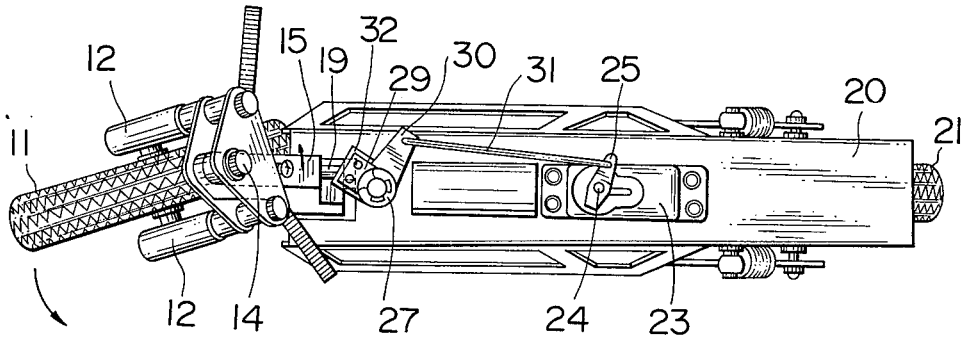
FIG. 4 is a schematic plan view showing the toy motorcycle turning to the left.

FIG. 1 illustrates the outline of a toy motorcycle mounting a radio-controlled steering device, and FIGS. 2 and 3 show the side and plan views of the essential portion of the motorcycle. A front wheel 11 supported by a fork 12 is equipped with shock absorbers 13. Designated a 14 is a handle shaft connected to the fork 12. Reference numeral 15 represents a connecting block which pivotally supports at its inclined front edge 16 the handle shaft 14 with resilient material 40 such as rubber also supporting the shaft 14. The handle shaft 14 is disposed near the upper end, of and between branches of the fork 12 and is inclined so as to give the front wheel a caster effect. A rear wheel 21 supported by the frame 20 is driven by a motor or engine 22 whose speed can be varied. A pivot shaft 26 lies on the central axis of the frame 20 and is positioned near the front end of the frame 20 and received in the lower portion 17 of the connecting block 15. Denoted at 23 is a steering servomotor driven by a radio signal which is transmitted from the transmitter (not shown) by an operator and received by the receiver 42 contained in the doll 41. A crank 25 is connected to the output shaft 24. A cylindrical rotor 27, which secures a lever 29 in place, receives an upright pin 28 which is located immediately behind the block 15 on the center axis of the frame 20. The lever 29 is connected at one end 30 with the crank 25 through a rod 31, and at the other end 32 loosely connected with the upper portion of the rear side 18 of the connecting block 15 through a pin 19.

The connecting block 15 pivotally receives in its front portion 16 the handle shaft 14 and has the pivot shaft 26 inserted in the lower portion thereof. The connecting block 15 also has a pin 19 embedded in the upper rear portion thereof, and is rotated about the pivot shaft 26 by the action of the lever connected with the pin.

This rotating force causes the connecting block 15 to be rotated or twisted, in relation to the frame 20, about the pivot shaft 26 or the central axis of the frame. How the steering device of this invention having a construction described above is operated will be explained in the following.

To turn the motorcycle to the left when it is running straight ahead, the transmitter is operated to rotate the steering servomotor 23 through a required angle clockwise, i.e., in a direction of the arrow A, FIG. 3. As a result, the interlocking action between the rod 31 and the lever 29 causes the pin 19 embedded in the connecting block 15 to move clockwise (with respect to the direction in which the motorcycle is moving) about the pivot shaft 26.

Figure 5:
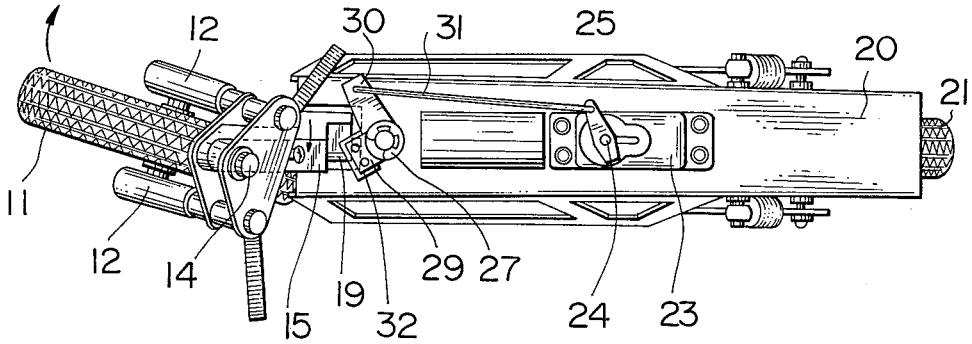
FIG. 5 is a schematic plan view showing the toy motorcycle turning to the right.
Figure 6:
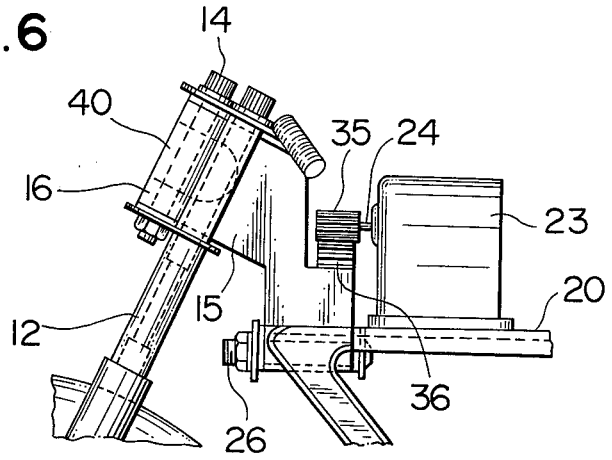
FIGS. 6 and 7 are enlarged side and plan views illustrating another example of transmission mechanism.
Figure 7:
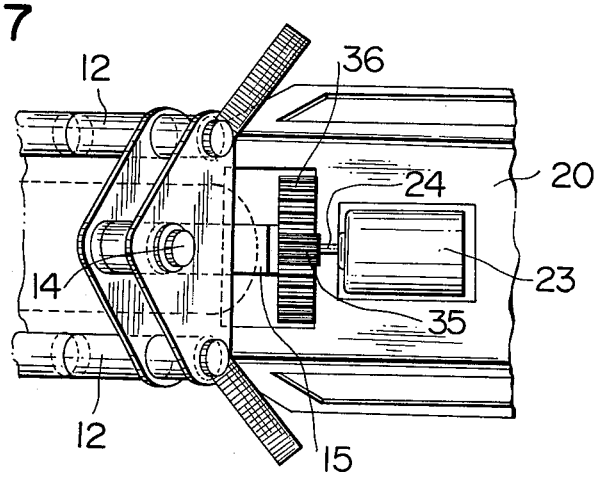
Figure 8:
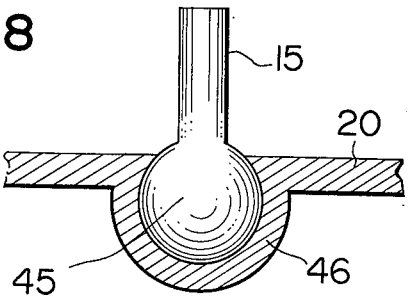
FIG. 8 is a vertical cross-sectional view of further example of transmission mechanism.

The motorcycle is still running and the caster effect of the front wheel tends to cause the motorcycle to run straight, generating a reaction or a moment acting on the base of the lever pin 28, i.e., the frame 20, about the engaging pin 19 as a center. Because of this moment, the frame is banked to the left through an angle corresponding to the rotating angle of the servomotor, with the result that the front wheel turns to the left by the caster effect and the motorcycle takes a course indicated by the arrow L. At this time, since the difference in the tilting angle between the front and rear wheels with respect to the ground generates a balancing force that tends to return the front wheel to the straight position, an accelerated banking as might be encountered in a toy motorcycle of gravitation type can be avoided; therefore smooth and stable running is ensured. To return the motorcycle to a straight running position, the operator is required to return the servomotor to the original position. This causes the steering mechanism to take a series of actions reverse to those described above. For turning the motorcycle to the right, the servomotor 13 is rotated counterclockwise, as shown in FIG. 5, through a required angle. Then the frame is banked to the right by an angle corresponding to the rotating angle of the servomotor in a manner already described. As a result, the front wheel is turned to the right and the motorcycle moves in the direction indicated by the arrow R, FIG. 3. As can be seen in the foregoing, the turning is effected by first banking the frame by rotating the servomotor through a desired angle and then turning the front wheel. In this way, the motorcycle can be turned smoothly and easily. In this example embodiment, the mechanism for transmitting the rotative force of the servomotor to the connecting block consists of a pin, a lever and a rod all interlocked. However, the same effect may be obtained if the transmission mechanism is comprised of a pinion 35 directly coupled to the output shaft of the servomotor and an arcuate rack 36 fixed on the upper portion of the block and in mesh with the pinion, as shown in FIGS. 6 and 7. Further, if the lower portion of the block 15 is formed arcuate, as shown at 45 in FIG. 8, and the frame 20 is provided with an arcuate bearing portion 46 to receive the arcuate surface 45 of the block 15, the pivot shaft 16 may be omitted. It should be noted that the relation between the rotating angle of the servomotor and the tilting angle of the frame can be set freely by introducing a desired transmission mechanism. The proper relation may be determined by experiments.

I claim:

1. A radio-controlled toy motorcycle comprising:

a frame having a longitudinal central axis and rotatably supporting a rear wheel which rotates about an axis at right angles to the central axis of the frame, a pivot shaft extending along the central axis of the frame of said toy motorcycle and being secured to the front end of the frame;

a connecting block coupled to said pivot shaft for rotation about the pivot shaft axis, a front wheel handle shaft rotatably mounted to the front end of said connecting block for rotation about a front wheel handle shaft axis inclined to the pivot shaft axis to provide a caster effect;

a fork connected to said front wheel handle shaft and aligned therewith, means for rotatably supporting a front wheel within said fork for rotation about an axis at right angles to the inclined pivot axis of said front wheel handle shaft, a servomotor mounted to said frame and driven by signals from a transmitter; and a transmission mechanism for transmitting the rotating force of said servomotor to said connecting block for rotating said connecting block about the axis of said pivot shaft to cause said front wheel to rotate about the inclined axis of said front wheel handle shaft and said frame to be banked by reaction of said caster effect of said front wheel to cause the toy motorcycle to turn easily and smoothly under nonaccelerated banking.

2. A radio-controlled toy motorcycle as claimed in claim 1, wherein said servomotor includes a servomotor shaft and wherein said transmission mechanism comprises an upright spindle located behind said connecting block, and a lever supported on said upright spindle and engaging at one end the upper portion of said connecting block and at the other end being connected through a connecting rod with a crank secured to a shaft of said servomotor.

3. A radio-controlled toy motorcycle as claimed in claim 1, wherein said servomotor includes a servomotor shaft and wherein said transmission mechanism comprises an arcuate rack secured behind the connecting block and a pinion carried by said servomotor shaft and being in mesh with said arcuate rack.

* * * * *